US010415313B2

(12) United States Patent
Barendregt

(10) Patent No.: US 10,415,313 B2
(45) Date of Patent: Sep. 17, 2019

(54) LADDER ASSEMBLY

(71) Applicant: William Bernard Barendregt, Anola (CA)

(72) Inventor: William Bernard Barendregt, Anola (CA)

( * ) Notice: Subject to any disclaimer, the term of this patent is extended or adjusted under 35 U.S.C. 154(b) by 0 days.

(21) Appl. No.: 15/008,754

(22) Filed: Jan. 28, 2016

(65) Prior Publication Data

US 2017/0218704 A1 Aug. 3, 2017

(51) Int. Cl.

| | |
|---|---|
| ***E06C 9/02*** | (2006.01) |
| ***E04F 19/00*** | (2006.01) |
| ***E06C 9/00*** | (2006.01) |
| ***E06C 1/00*** | (2006.01) |
| *E04F 19/08* | (2006.01) |

(52) U.S. Cl.

CPC ..... *E06C 9/02* (2013.01); *E04F 19/00* (2013.01); *E06C 1/005* (2013.01); *E06C 9/00* (2013.01); *E04F 19/08* (2013.01)

(58) Field of Classification Search

CPC ..... E06C 9/00; E06C 9/02; E06C 9/04; E04F 19/00

See application file for complete search history.

(56) References Cited

U.S. PATENT DOCUMENTS

| | | | | |
|---|---|---|---|---|
| 301,138 A | | 7/1884 | MacDonald | |
| 381,656 A | * | 4/1888 | Thompson | E06C 7/003 123/46 R |
| 405,397 A | | 6/1889 | Coon | |
| 490,362 A | | 1/1893 | Rich | |
| 745,140 A | | 11/1903 | Bielhen | |
| 882,499 A | | 3/1908 | Hull | |
| 1,134,468 A | | 4/1915 | Lemons | |
| 1,193,862 A | * | 8/1916 | Booraem | E04H 4/144 182/90 |
| 2,285,004 A | * | 6/1942 | Barriball | E06C 9/04 182/217 |
| 3,024,862 A | | 3/1962 | Rishcoff | |

(Continued)

FOREIGN PATENT DOCUMENTS

| | | |
|---|---|---|
| CA | D44977 | 2/1979 |
| CA | D45288 | 4/1979 |
| CN | 104291191 | 7/2016 |

OTHER PUBLICATIONS

Breton, Written Opinion for PCT/CA2017/050047, dated Mar. 6, 2017.

*Primary Examiner* — Katherine W Mitchell
*Assistant Examiner* — Shiref M Mekhaeil

(57) ABSTRACT

An apparatus includes a ladder assembly configured to be used with a vertically-extending wall assembly of a building having a window assembly installed to the vertically-extending wall assembly. The ladder assembly includes a housing assembly configured to be fixedly received (at least in part) in the vertically-extending wall assembly, to be mounted to the vertically-extending wall assembly, and to extend (at least in part) into the vertically-extending wall assembly of the building. A support assembly is configured to be fixedly attached to the housing assembly, and to extend (at least in part) into the housing assembly in such a way that the support assembly bisects the housing assembly. The support assembly, in use, provides any one of a handhold and a foothold configured for usage by a user.

17 Claims, 10 Drawing Sheets

(56) References Cited

U.S. PATENT DOCUMENTS 3,195,966 A * 7/1965 Doherty ..... A47B 87/02 182/131
3,415,341 A 12/1968 Hostetler
4,121,691 A * 10/1978 Poplawski ..... B60R 3/00 182/90
4,222,458 A 9/1980 Pratt
4,462,486 A * 7/1984 Dignan ..... B60R 3/02 182/91
4,569,533 A * 2/1986 Gronert ..... B60R 3/00 105/443
4,574,916 A 3/1986 Hunt et al.
5,277,271 A * 1/1994 Lemay ..... E06C 9/14 182/237
5,908,082 A * 6/1999 Turner ..... A62B 1/20 182/18
5,971,102 A * 10/1999 Brown ..... E06C 7/003 182/129
D449,264 S * 10/2001 Weinerman ..... D12/203
6,471,002 B1 * 10/2002 Weinerman ..... B60R 3/02 182/90
D505,900 S * 6/2005 Oravec, III ..... D12/203
7,416,232 B2 * 8/2008 Tier ..... B60R 3/00 280/163
7,828,118 B2 * 11/2010 Barbara ..... B61D 23/00 105/443
8,646,223 B2 2/2014 Brewka et al.
8,668,217 B2 * 3/2014 Ziaylek ..... B60R 3/02 280/163
8,720,133 B1 5/2014 Hunt
8,905,354 B2 * 12/2014 Griffiths ..... B64C 1/24 182/89
9,126,535 B1 * 9/2015 Moore ..... B62D 25/168
2005/0134070 A1 * 6/2005 Plentis ..... B60R 9/02 296/37.1
2014/0110193 A1 * 4/2014 Conley ..... B60R 3/02 182/91

* cited by examiner

LADDER ASSEMBLY

TECHNICAL FIELD

This document relates to the technical field of (and is not limited to) an apparatus including a ladder assembly configured to use with a vertically-extending wall assembly of a building.

BACKGROUND

A ladder is a vertical or inclined set of rungs or steps. There are two types of ladders: rigid ladders that can be leaned against a vertical surface such as a wall, and rope ladders that are hung. The vertical members of a rigid ladder are called stringers, rails or stiles. Rigid ladders are usually portable, but some types are permanently affixed to buildings. They are commonly made of metal, wood, or fiberglass, and tough plastic.

SUMMARY

It will be appreciated that there exists a need to mitigate (at least in part) at least one problem associated with the existing ladders (also called the existing technology). After much study of the known systems and methods with experimentation, an understanding of the problem and its solution has been identified and is articulated as follows:

The existing ladder may be used for escaping a fire (from a building). It may be inconvenient to deploy the existing ladder for such a purpose (so that the user may escape from a burning building or may simply exit from the building for other reasons), etc.

What is needed is a ladder system that is convenient and relatively easy to install and/or deploy in comparison to the existing ladder, and more preferably, a ladder that enables children and/or adults to safely escape from a window, and more preferably a ladder that reduces the possibility of injury or confusion in an escape situation from a building, and does not impede daily use (of the building).

To mitigate, at least in part, at least one problem associated with the existing technology, there is provided (in accordance with a major aspect) an apparatus. The apparatus includes a ladder assembly configured to use with a vertically-extending wall assembly of a building having a window assembly installed to the vertically-extending wall assembly. The ladder assembly includes a housing assembly configured to be fixedly received (at least in part) in the vertically-extending wall assembly, and to be mounted (at least in part) to the vertically-extending wall assembly of the building. A support assembly is configured to be fixedly attached (at least in part) to the housing assembly, and to extend (at least in part) into the housing assembly in such a way that the support assembly bisects the housing assembly. The support assembly, in use, provides any one of a handhold and a foothold configured for usage by a user.

Other aspects are identified in the claims.

Other aspects and features of the non-limiting embodiments may now become apparent to those skilled in the art upon review of the following detailed description of the non-limiting embodiments with the accompanying drawings.

This Summary is provided to introduce concepts in simplified form that are further described below in the Detailed Description. This Summary is not intended to identify key features or essential features of the disclosed or claimed subject matter, and is not intended to describe each disclosed embodiment or every implementation of the disclosed or claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
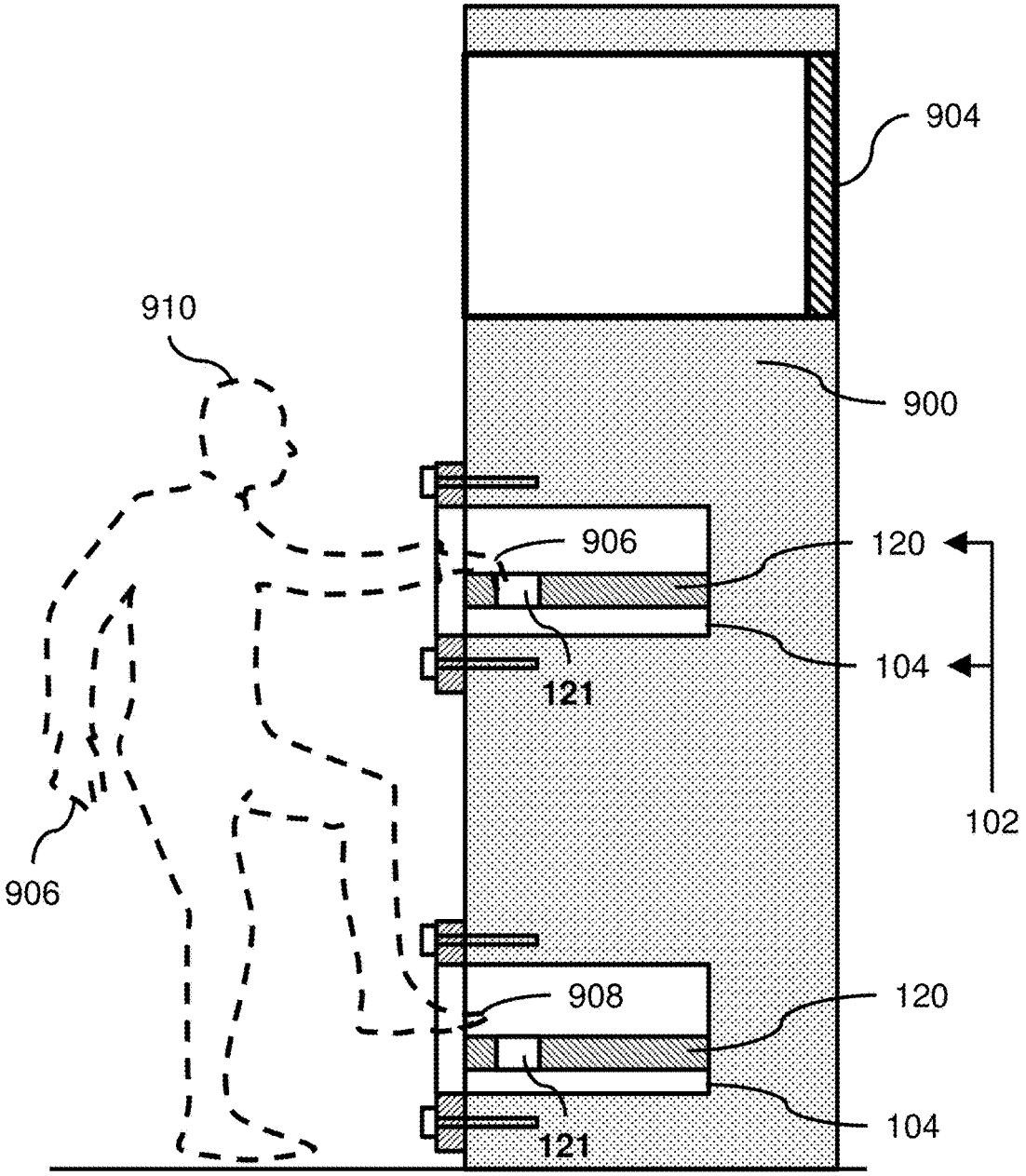
FIG. 1 (SHEET 1 OF 10) depicts a side view of a first embodiment of an apparatus including a ladder assembly.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted.

Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

102 ladder assembly
104 housing assembly
106 entrance channel
108 housing cavity
110 lateral side walls
112 top wall
114 bottom wall
116 back wall
120 support assembly
121 hand-holding groove
122 drawer assembly
123 non-slip surface
124 mounting bracket assembly
126 frame assembly

127 spaced-apart mounting holes
128 front panel
129 see-through panel
130 frontal face plate
132 safety belt hook
134 lock panel
136 lock device
138 key
140 drainage portal
142 lamp device
144 connector
145 receiving holes
146 connector
900 vertically-extending wall assembly
901 wall studs
904 window assembly
906 hand
908 foot
910 user

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the invention is defined by the claims. For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described.

FIG. 1 depicts a cross-sectional side view of a first embodiment of an apparatus including a ladder assembly 102.

In accordance with the first embodiment as depicted in FIG. 1 (and is applicable to all other embodiments as depicted in the FIGS.), the apparatus includes (and is not limited to) a ladder assembly 102. The ladder assembly 102 is configured to use with a vertically-extending wall assembly 900 of a building (known and not depicted) having a window assembly 904 installed to the vertically-extending wall assembly 900. The ladder assembly 102 includes (and is not limited to) a synergistic combination of a housing assembly 104 and a support assembly 120 (also called a rung assembly or a shelf assembly, etc.). The housing assembly 104 is configured to be fixedly received (at least in part) in the vertically-extending wall assembly 900, and to be fixedly mounted to (at least in part) the vertically-extending wall assembly 900, and to extend (at least in part) into the vertically-extending wall assembly 900 of the building. More preferably, the housing assembly 104 is configured to be fixedly received (at least in part) in the vertically-extending wall assembly 900, and to be fixedly mounted (at least in part) to the vertically-extending wall assembly 900, and to extend entirely into the vertically-extending wall assembly 900 of the building (if so desired). The support assembly 120 may be called a crosspiece, a horizontal support, a tubular member, etc., and any equivalent thereof. The support assembly 120 is configured to be fixedly attached (at least in part) to the housing assembly 104, and to extend (at least in part) into the housing assembly 104. This is done in such a way that the support assembly 120 bisects the housing assembly 104. The support assembly 120, in use, provides any one of a handhold and a foothold configured for usage by a user 910.

Preferably, the ladder assembly 102 is configured to be used as a fire escape (leading to a window, so that the user may escape from the building or to simply exit the building). It will be appreciated that the ladder assembly 102 may be used for other types of situations.

In accordance with a preferred embodiment, the ladder assembly 102 is flush mounted with (flush mounted to) the vertically-extending wall assembly 900. The ladder assembly 102 enables children and adults to safely escape from a window. The ladder assembly 102 solves the possibility of injury or confusion in an escape situation from a building. The ladder assembly 102 may be installed in a relatively straightforward manner, and the ladder assembly 102 does not impede daily use (of the building). Once the ladder assembly 102 is installed, there is no need for existing ladders (existing technology), etc. It will be appreciated that the ladder assembly 102 may be used for difficult to access areas, etc.

In accordance with preferred embodiments, the housing assembly 104 is configured to accommodate the size of a fire department boot used by a firefighter. Preferably, the support assembly 120 includes a plate body configured to be received in the interior of the housing assembly 104, and the support assembly 120 provides (defines) a hand-holding groove 121 (also called, a channel or a recessed handle, etc.) that faces any one of upwardly and downwardly, etc. The hand-holding groove 121 is positioned proximate to the frontal section of the support assembly 120 (and proximate to the frontal section of the housing assembly 104 once the support assembly 120 is received in the housing assembly 104).

Figure 2:
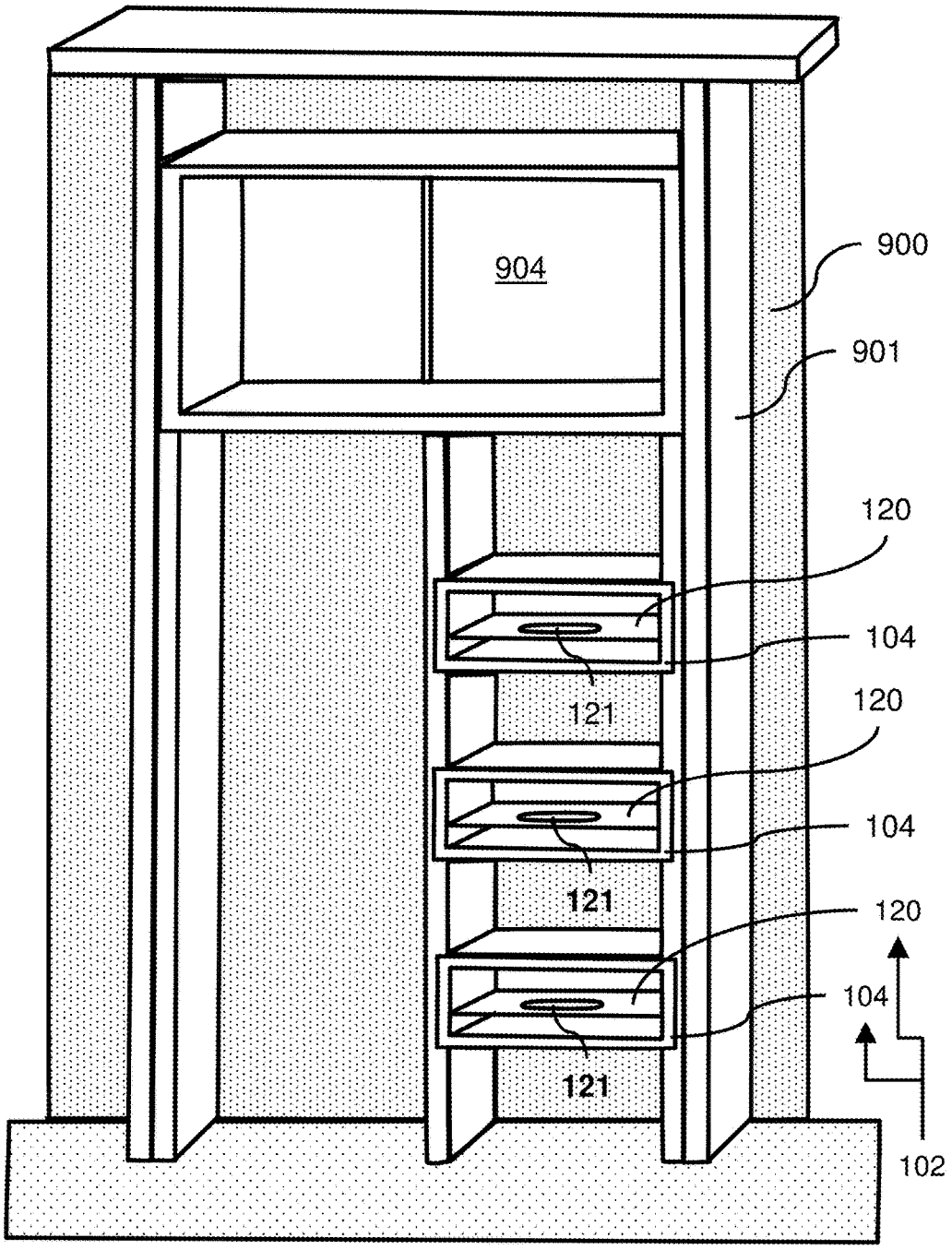
FIGS. 2 and 3 (SHEETS 2 and 3 OF 10) depict views of a second embodiment of the apparatus of FIG. 1.
Figure 3:
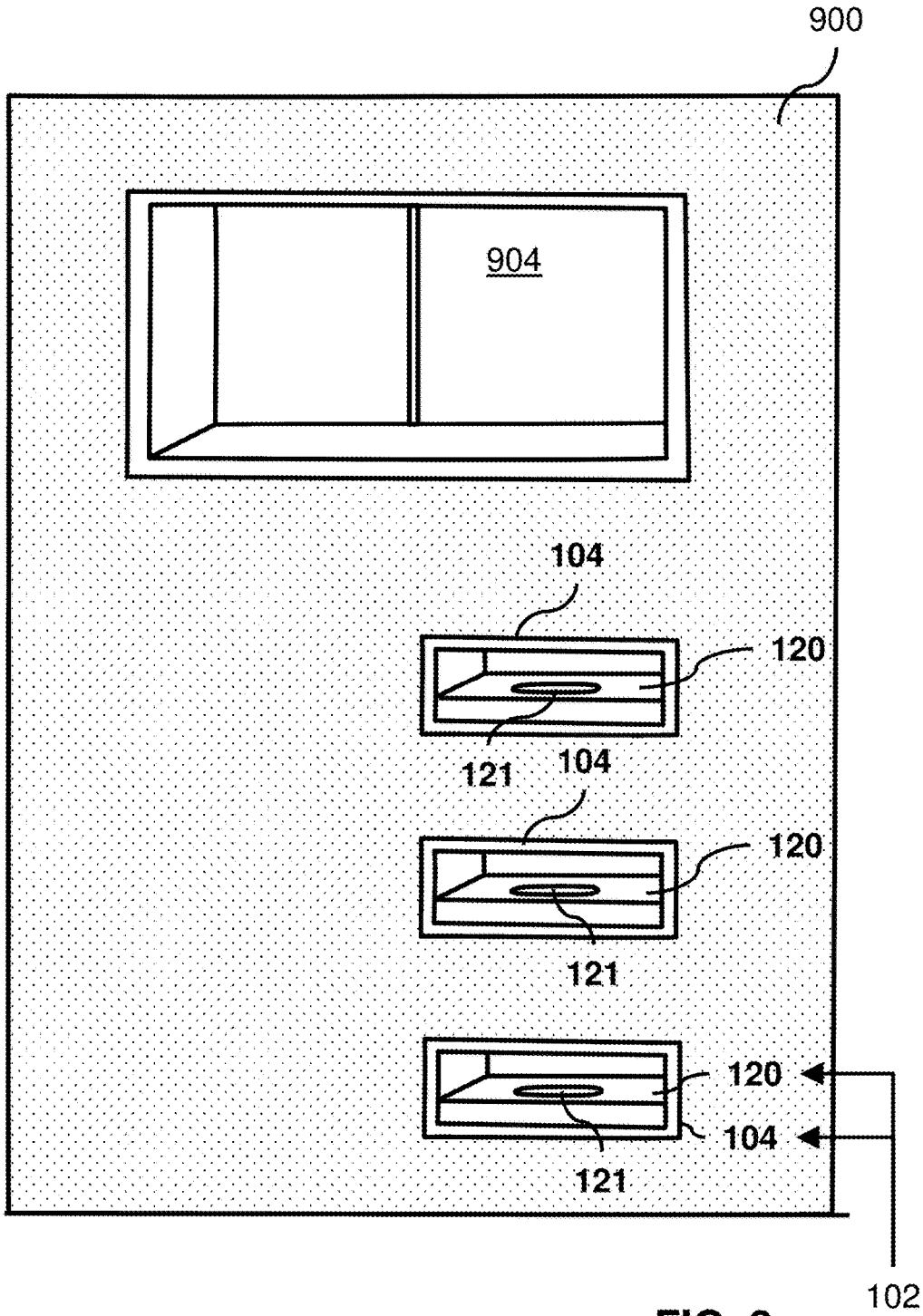

FIGS. 2 and 3 depict frontal perspective views of a second embodiment of the apparatus of FIG. 1.

In accordance with the second embodiment as depicted in FIGS. 2 and 3 (and is applicable to all other embodiments as depicted in the FIGS.), the apparatus includes (and is not limited to) a ladder assembly 102 configured to use with a vertically-extending wall assembly 900 of a building having a window assembly 904 installed to the vertically-extending wall assembly 900. The ladder assembly 102 includes a synergistic combination of a housing assembly 104 and a support assembly 120. The housing assembly 104 is configured to be fixedly received (at least in part) in the vertically-extending wall assembly 900, and to be mounted to (to be fixedly mounted to, at least in part) to the vertically-extending wall assembly 900 of the building, and to be positioned below the window assembly 904; this is done in such a way that the housing assembly 104 (A) extends (at least in part) into an interior of the vertically-extending wall assembly 900 of the building, and (B) is spaced apart from the window assembly 904 once the housing assembly 104 is fixedly received by (and mounted to) the vertically-extending wall assembly 900 of the building. The support assembly 120 is configured to be fixedly attached (at least in part) to the housing assembly 104, and to extend (at least in part) into the housing assembly 104. This is done in such a way that the support assembly 120 bisects the housing assembly 104. The support assembly 120, in use, provides any one of a handhold and a foothold configured for usage by any one of a hand 906 and a foot 908 of a user 910 (this is done in such a way that the user 910 uses the support assembly 120 to climb toward the window assembly 904 installed in the vertically-extending wall assembly 900 and above the housing assembly 104).

It will be appreciated that since the window assembly 904 is known, the details regarding the window assembly 904, such as a user handle, etc., are not depicted, and that the window assembly 904 is not part of the apparatus.

In accordance with the embodiment as depicted in FIG. 2, the housing assembly 104 is configured to be installed to, and to span between, wall studs 901 of the vertically-extending wall assembly 900. For instance, the ladder assembly 102 is installed in any one of the basement and the second floor (or any floor higher than the first floor) of a building (wherever needed or required).

As depicted in FIGS. 2 and 3, the ladder assembly 102 is installable on an inside wall section of the building (and faces the interior of the building). FIGS. 2 and 3 depict the case for dry wall installation of the ladder assembly 102.

Figure 4:
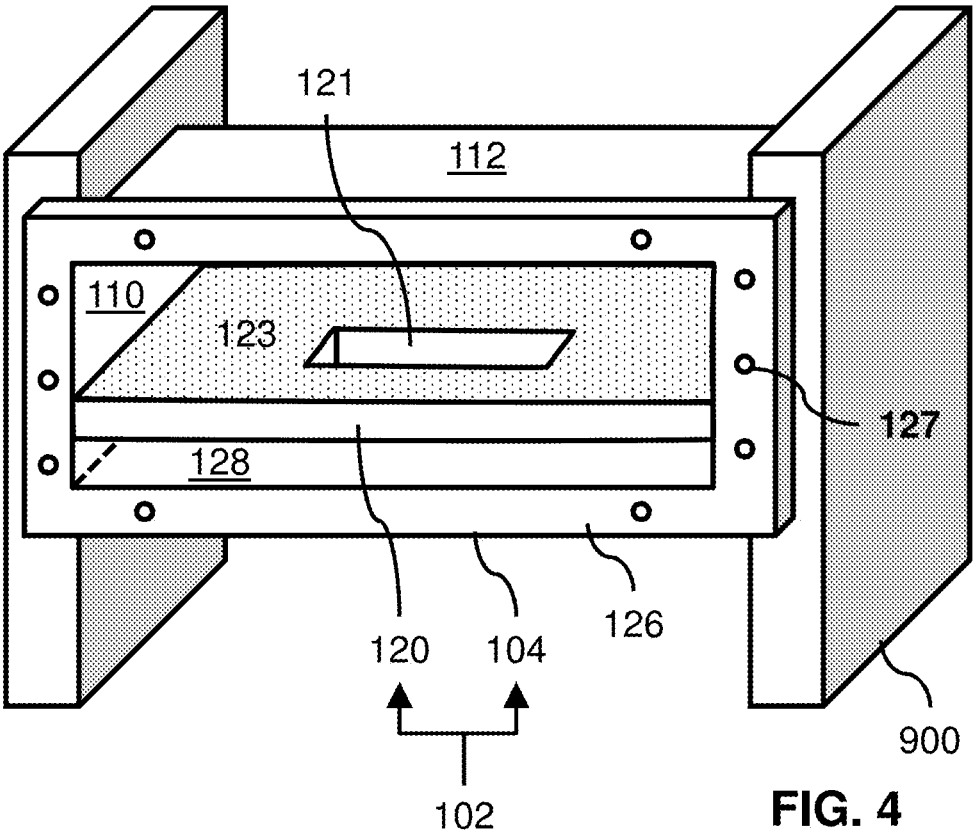
FIGS. 4 to 8 (SHEETS 4 to 5 of 10) depict views of a third embodiment of the apparatus of FIG. 1.
Figure 5:
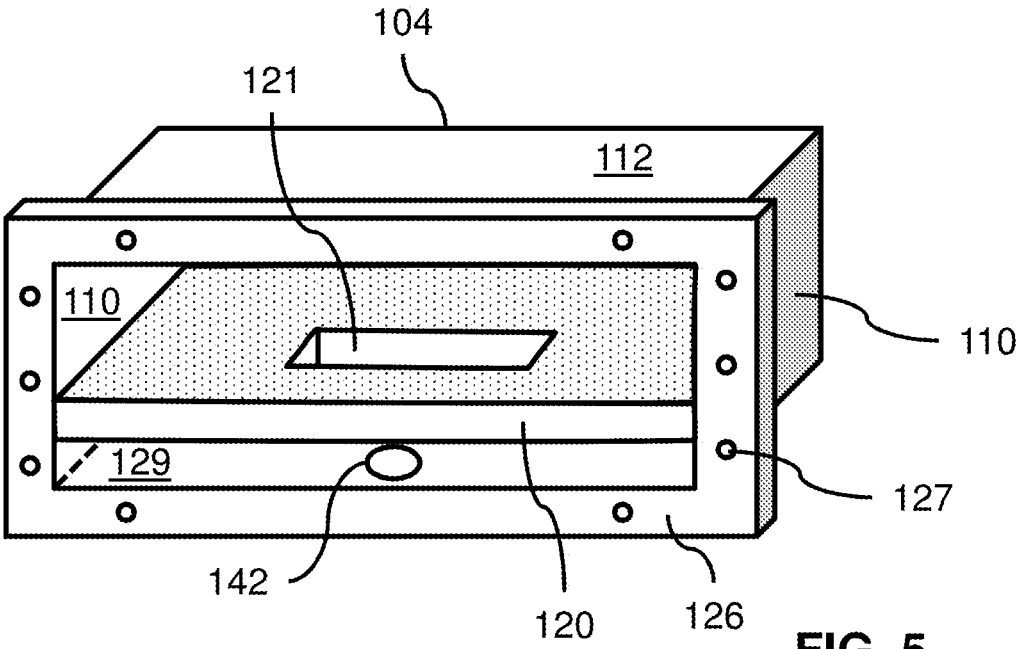
Figure 6:
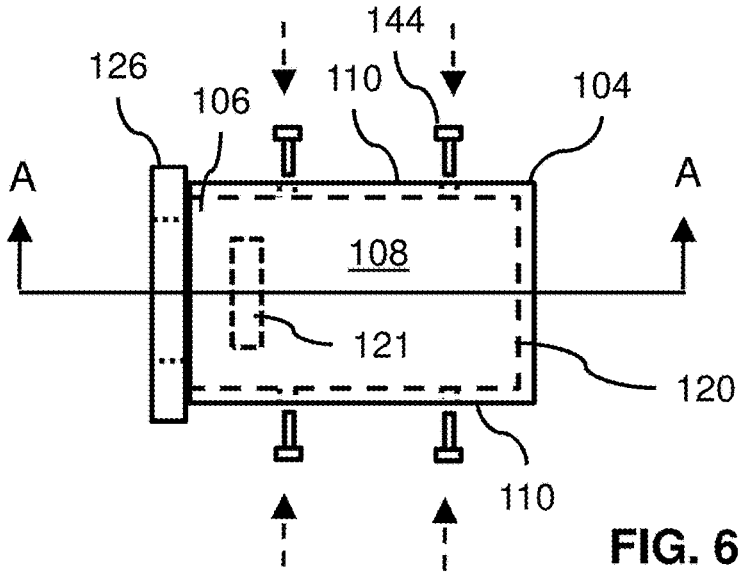
Figure 7:
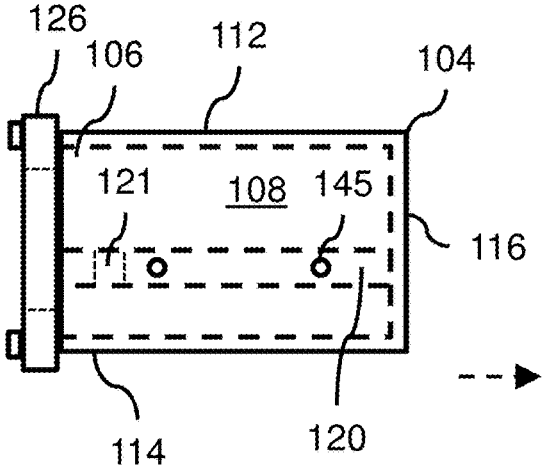
Figure 8:
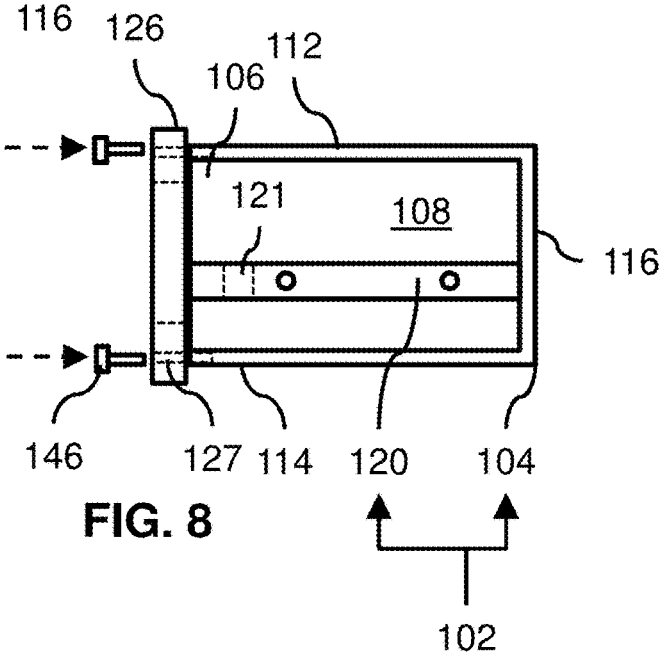

FIGS. 4 to 8 depict views of a third embodiment of the apparatus of FIG. 1. FIGS. 4 and 5 depict frontal perspective views. FIG. 6 depicts a top view. FIGS. 7 and 8 depict side views.

In accordance with the third embodiment as depicted in FIGS. 4 to 8 (and is applicable to all other embodiments as depicted in the FIGS.), the apparatus includes (and is not limited to) a ladder assembly 102. The ladder assembly 102 is configured to be used with a vertically-extending wall assembly 900 of a building having a window assembly 904 installed to the vertically-extending wall assembly 900. The ladder assembly 102 includes a synergistic combination of a housing assembly 104 and a support assembly 120. The housing assembly 104 is configured to be fixedly received (at least in part) in the vertically-extending wall assembly 900, and to be mounted to (at least in part) the vertically-extending wall assembly 900 of the building, and to be positioned below the window assembly 904. This is done in such a way that the housing assembly 104 extends, at least in part, into an interior of the vertically-extending wall assembly 900 of the building and is spaced apart from the window assembly 904 (once the housing assembly 104 is fixedly received, at least in part, in the vertically-extending wall assembly 900, and mounted to, at least in part, the vertically-extending wall assembly 900 of the building). As depicted in FIGS. 6-8, the housing assembly 104 forms an entrance channel 106 leading to a housing cavity 108 defined by the housing assembly 104. The housing assembly 104 includes opposite lateral side walls 110 (also called lateral vertical walls), a top wall 112, a bottom wall 114 and a back wall 116 (that is, five sides or five walls), which define the housing cavity 108.

The support assembly 120 is configured to: (A) be fixedly attached to the opposite lateral side walls 110 of the housing assembly 104, and (B) extend (at least in part) into a mid-section of the housing cavity 108 of the housing assembly 104. This is done in such a way that the support assembly 120 (A) bisects the housing assembly 104, and (B) extends between the opposite lateral side walls 110 of the housing assembly 104, and (C) is spaced apart from, and is positioned between, the top side 114 and the bottom side 116 of the housing assembly 104, and (D) extends, at least in part, into the housing cavity 108 of the housing assembly 104. The support assembly 120, in use, provides any one of a handhold and a foothold configured for usage by any one of a hand 906 and a foot 908 of a user 910 in such a way that the user 910 uses the support assembly 120 to climb toward the window assembly 904 installed in the vertically-extending wall assembly 900 and above the housing assembly 104.

In accordance with the embodiment as depicted in FIG. 4, the housing assembly 104 includes a frame assembly 126 that extends along the outer periphery of the housing assembly 104. Preferably, the housing assembly 104 includes a frame assembly 126 configured to fit and cover the lower open section that is positioned below the support assembly 120. Preferably, the support assembly 120 includes a non-slip surface 123 configured to resist slippage between the user and the support assembly 120. The frame assembly 126 defines (provides) spaced-apart mounting holes 127 positioned on the outer-facing edge of the frame assembly 126. Preferably, the support assembly 120 includes a step assembly that is configured to be inserted into the housing assembly 104, and to be fixedly attached thereto (once inserted therein).

In accordance with an option, the support assembly 120 is mounted with the housing assembly 104 in an off-centered orientation in such a way that the space above the support assembly 120 is relatively larger than the space located below the support assembly 120. In accordance with an option, the housing assembly 104 includes a lamp device 142 (such as a light emitting diode, etc., and any equivalent thereof). The lamp device 142 may be battery powered with a control switch, etc. The bottom section located below the support assembly 120 may be fitted with a see-through panel 129 (for allowing visual access for the lamp device 142).

In accordance with the embodiment as depicted in FIG. 6, the support assembly 120 is inserted into the interior of the housing assembly 104. A connector 144 is configured to securely connect the support assembly 120 to the lateral side walls 110 of the housing assembly 104. In accordance with the embodiment as depicted in FIG. 7, the support assembly 120 defines receiving holes 145 configured to receive the connector 144 (as depicted in FIG. 6). In accordance with the embodiment as depicted in FIG. 8, a connector 146 is used to affix the frame assembly 126 to the housing assembly 104.

Figure 9:
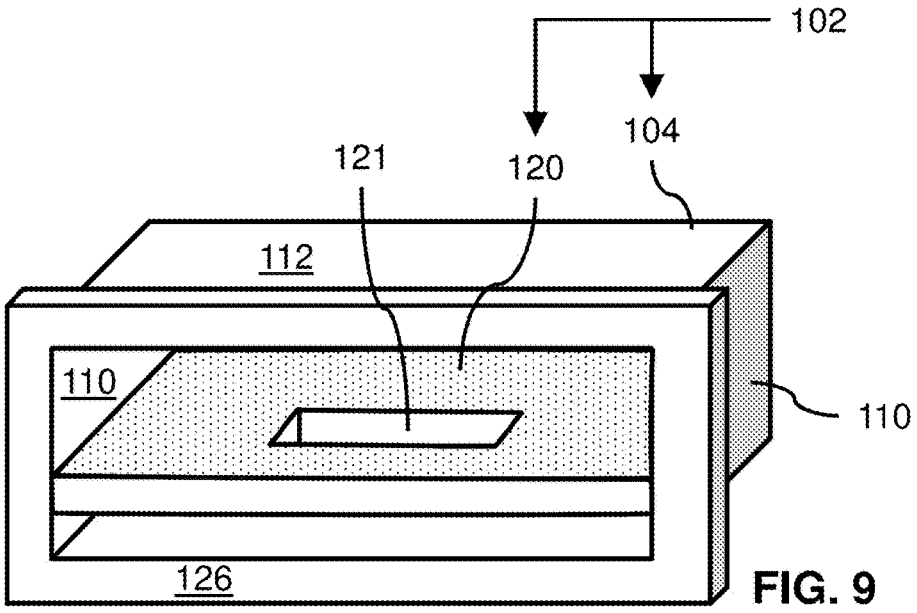
FIG. 9 (SHEET 6 OF 10) depicts a view of a fourth embodiment of the apparatus of FIG. 1.

FIG. 9 depicts a frontal perspective view of a fourth embodiment of the apparatus of FIG. 1.

In accordance with the embodiment as depicted in FIG. 9, the housing assembly 104 further includes a frame assembly 126. Preferably, the frame assembly 126 defines no mounting holes, and the housing assembly 104 is configured to be received (at least in part) in the vertically-extending wall assembly 900.

Figure 10:
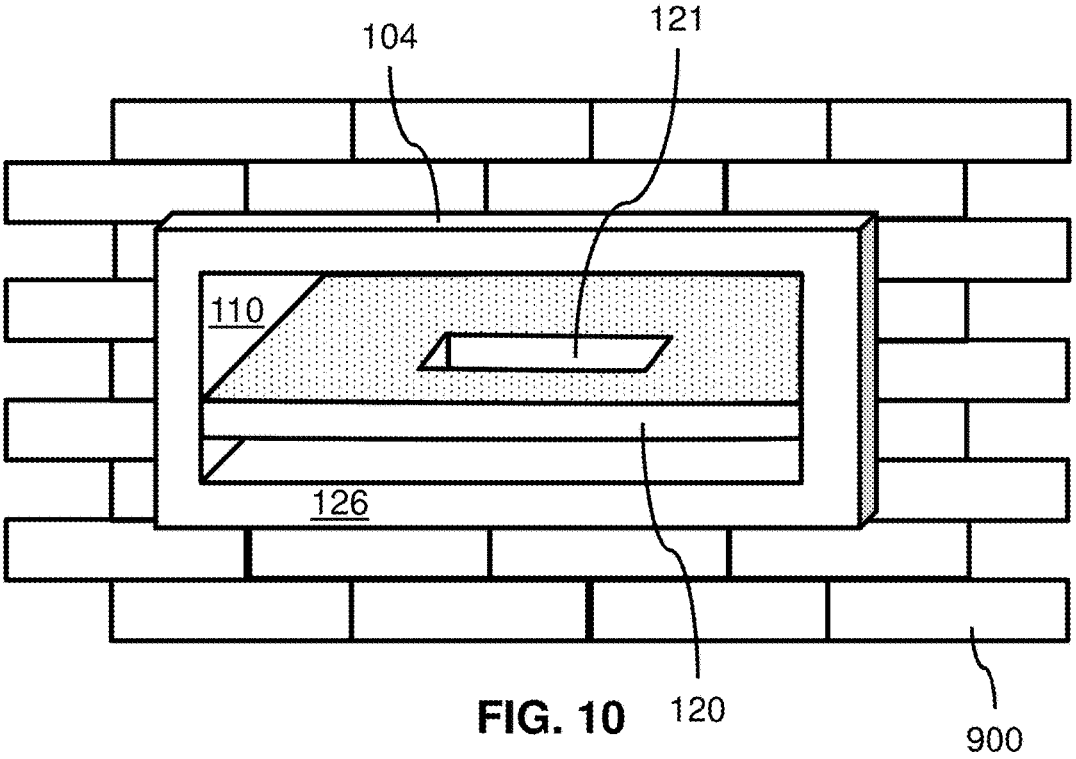
FIG. 10 (SHEET 6 OF 10) depicts a view of a fifth embodiment of the apparatus of FIG. 1.

FIG. 10 depicts a frontal perspective view of a fifth embodiment of the apparatus of FIG. 1.

In accordance with the embodiment as depicted in FIG. 10, the ladder assembly 102 is installable to the vertically-extending wall assembly 900 (in which the vertically-extending wall assembly 900 includes an exterior wall of a building, and the ladder assembly 102 opens to the exterior of the building). The vertically-extending wall assembly 900 includes a concrete wall, a brick wall, etc., and any equivalent thereof.

Figure 11:
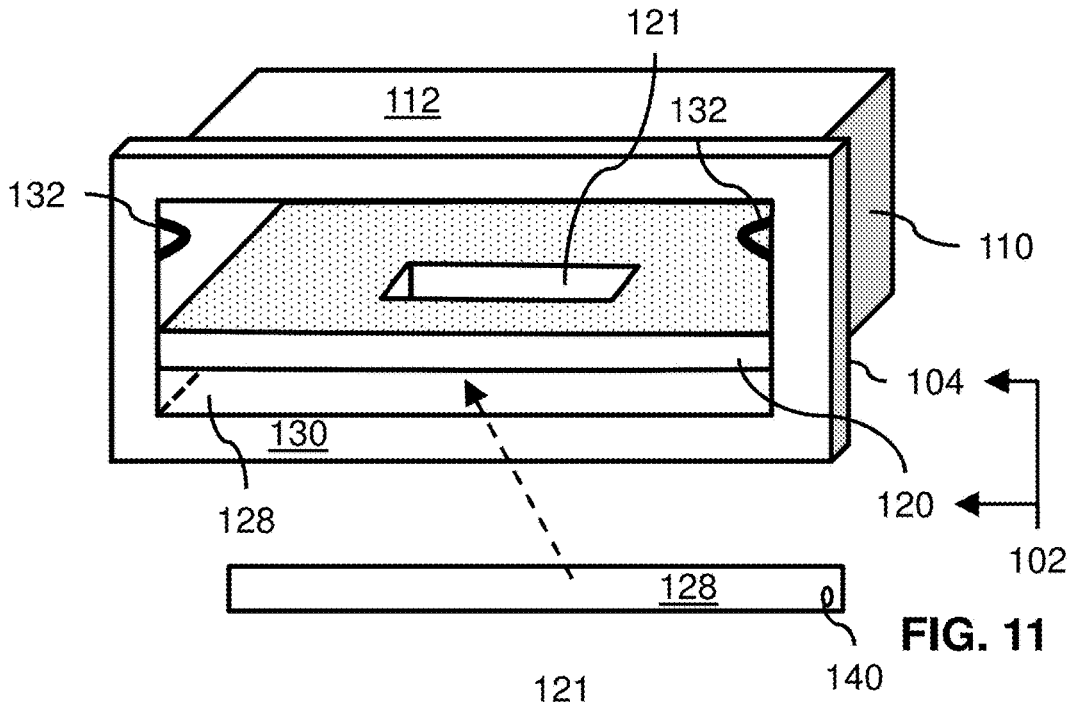
FIGS. 11 and 12 (SHEET 7 OF 10) depict views of a sixth embodiment of the apparatus of FIG. 1.
Figure 12:
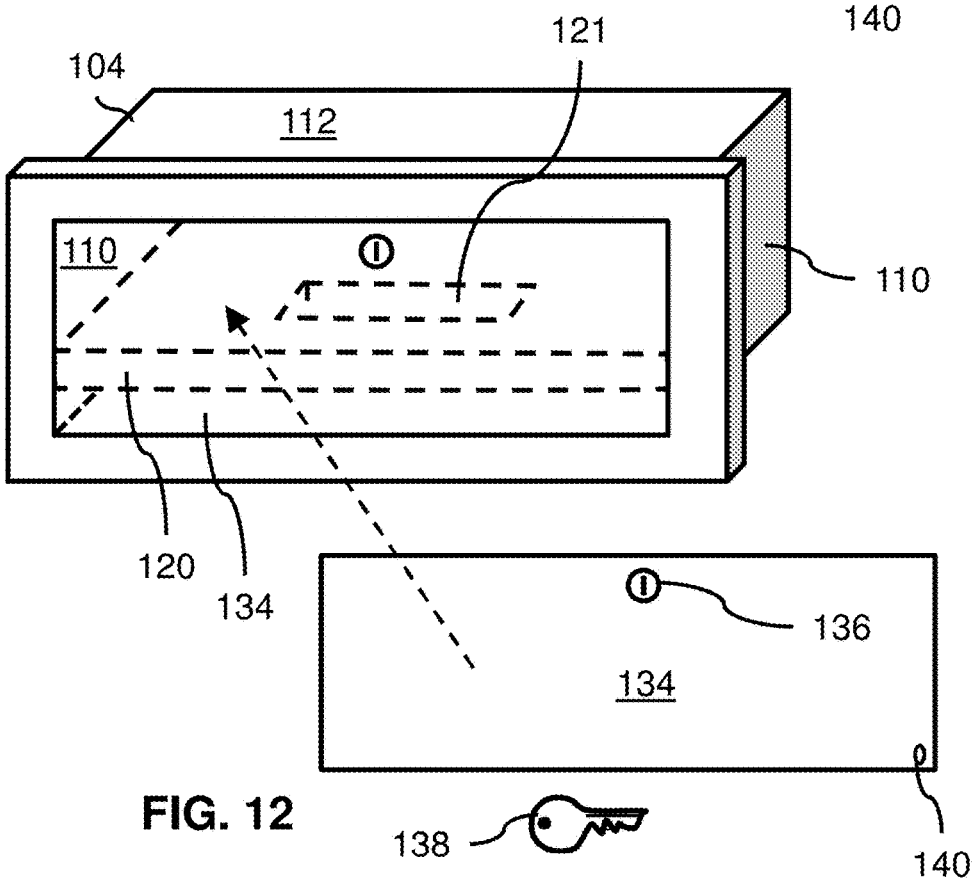

FIGS. 11 and 12 depict frontal perspective views of a sixth embodiment of the apparatus of FIG. 1.

In accordance with the embodiment as depicted in FIG. 11, the housing assembly 104 further includes a frontal face plate 130 configured to cover the peripheral front edges of the housing assembly 104. Preferably, the frontal face plate 130 does not define mounting holes. Located below the support assembly 120, there is an open space between the frontal face plate 130 and the support assembly 120. In accordance with the embodiment as depicted in FIG. 11, the housing assembly 104 further includes a front panel 128. The front panel 128 is configured to fit and cover the open space positioned below the support assembly 120 (between the support assembly 120 and the bottom section of the frontal face plate 130). In accordance with an embodiment as depicted in FIG. 11, the housing assembly 104 further includes a safety belt hook 132. The safety belt hook 132 is fixedly mounted to any one of the housing assembly 104 and the frontal face plate 130. The safety belt hook 132 is configured to assist the user to climb the ladder assembly 102. The safety belt hook 132 may be installed for interior or exterior installations of the ladder assembly 102.

In accordance with the embodiment as depicted in FIG. 12, the housing assembly 104 further includes a lock panel 134 having a lock device 136 installed thereto. A key 138 is configured to lock and unlock the lock device 136. The lock device 136 is configured to securely lock the position of the lock panel 134 to any one of the housing assembly 104 and the frontal face plate 130. The lock device 136 is used to prevent unauthorized usage of the ladder assembly 102 (for the case where the ladder assembly 102 is installed outdoors).

For the case where the ladder assembly 102 is installed to an exterior wall of the building, the front panel 128 and/or the lock panel 134 define a drainage portal 140 (for allowing rain water to exit from the interior of the housing assembly 104).

Figure 13:
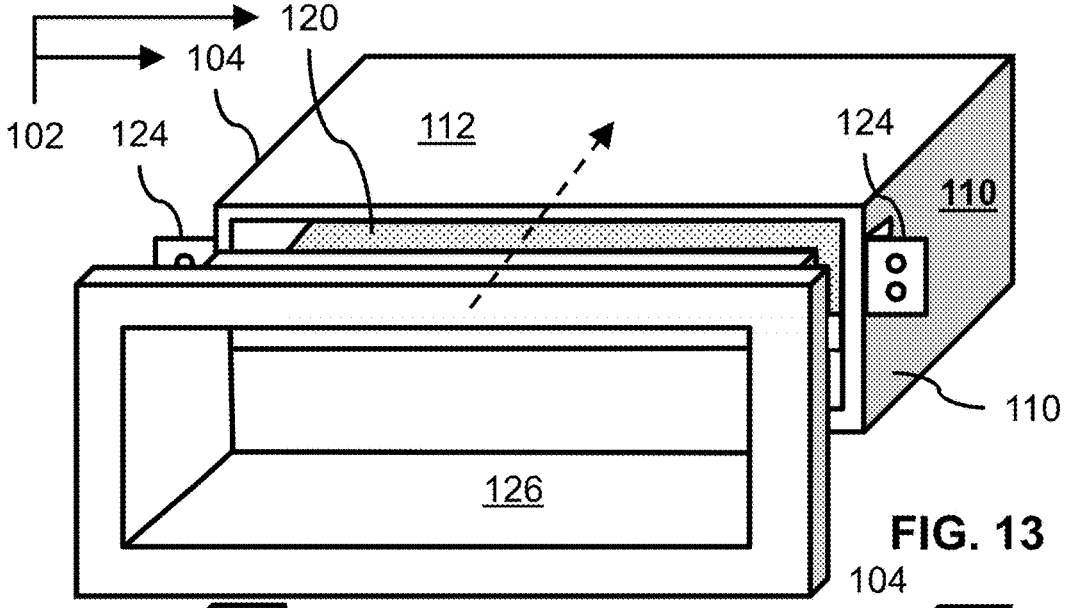
FIGS. 13 to 16 (SHEET 8 OF 10) depict views of a seventh embodiment of the apparatus of FIG. 1.
Figure 14:
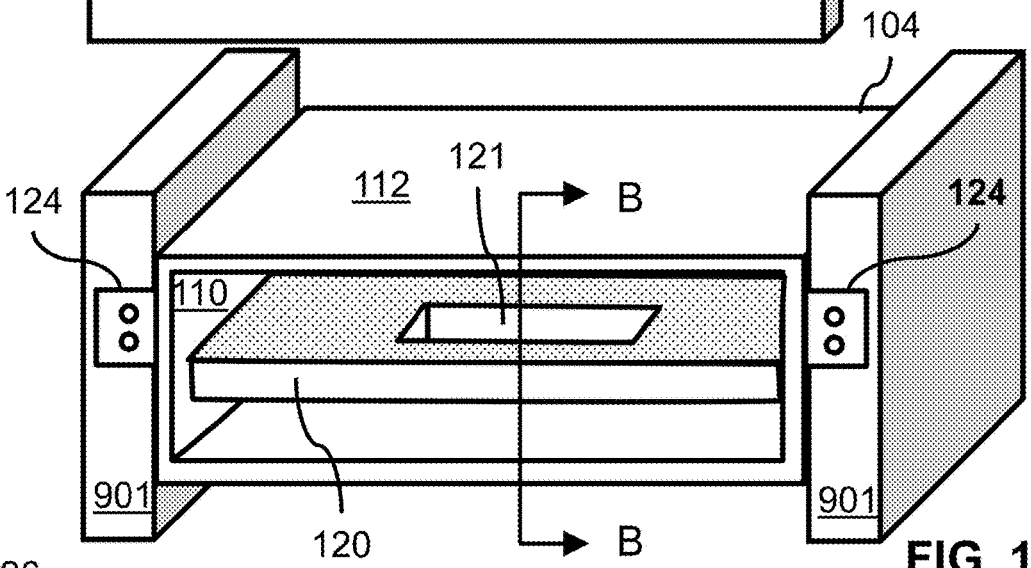
Figure 15:
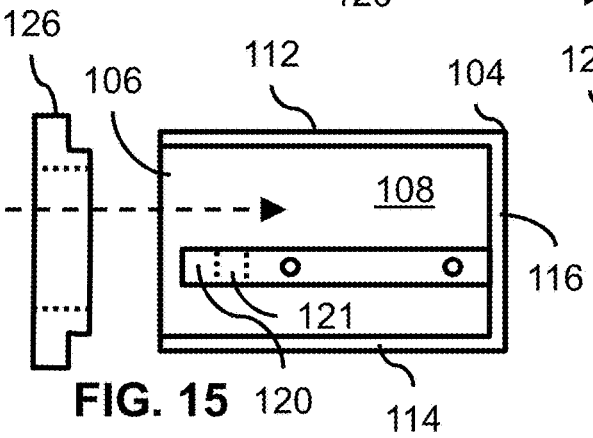
Figure 16:
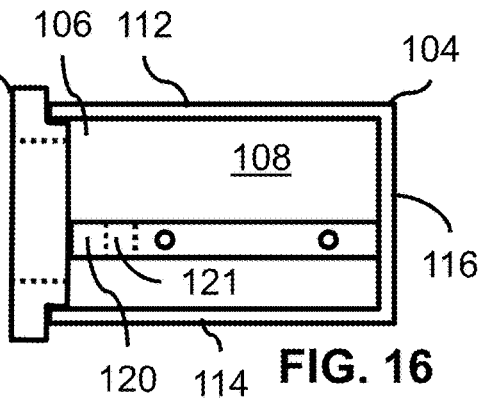

FIGS. 13 to 16 depict views of a seventh embodiment of the apparatus of FIG. 1. FIGS. 13 and 14 depict frontal perspective views. FIGS. 15 and 16 depict side views.

In accordance with the embodiments as depicted in FIGS. 13 to 16, the housing assembly 104 further includes a mounting bracket assembly 124. Preferably, the mounting bracket assembly 124 includes an L-shaped body. The mounting bracket assembly 124 is configured to attach to the housing assembly 104 (specifically, to the lateral side walls 110 of the housing assembly 104). The mounting bracket assembly 124 is also configured to be fixedly attached to the wall studs 901. More preferably, two instances of the mounting bracket assembly 124 are configured to be fixedly attached to respective spaced-apart instances of the wall studs 901. The wall studs 901 are attached to or placed against a wall (or form part of a wall) of the building. For instance, the frame assembly 126 includes mounting holes configured to receive a wood screw (and any equivalent thereof) that may be used to fixedly attach the mounting bracket assembly 124 to the wall studs 901. The frame assembly 126 is configured to be retractable relative to the housing assembly 104.

The housing assembly 104 further includes a frame assembly 126. The frame assembly 126 is configured to be received (at least in part) in the front entrance of the housing assembly 104. In accordance with an option, the frame assembly 126 includes an outer peripheral flange portion that abuts the peripheral edge surfaces leading to the entrance of the interior of the housing assembly 104. In accordance with an option, the frame assembly 126 may be fixedly attached to the housing assembly 104 by using connectors (such as, screws), and any equivalent thereof. In accordance with an option, the frame assembly 126 slides into (at least in part) the front entrance of the housing assembly 104, and is held in place by a snap-click (snap fit) connector (known and not depicted).

Figure 17:
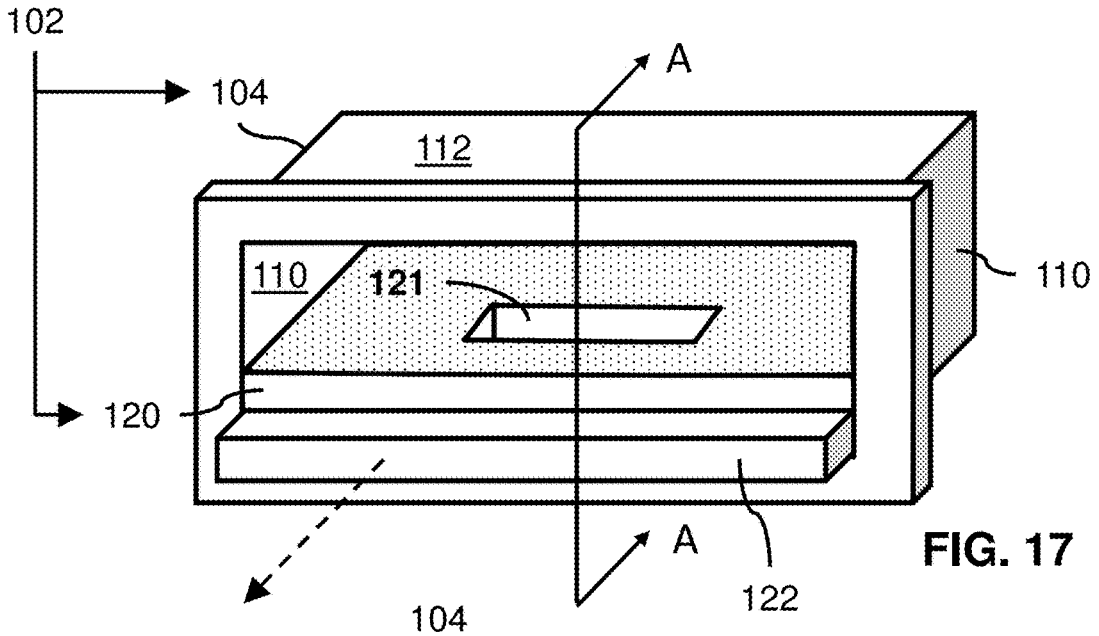
FIGS. 17 to 20 (SHEET 9 OF 10) depict views of an eighth embodiment of the apparatus of FIG. 1.
Figure 18:
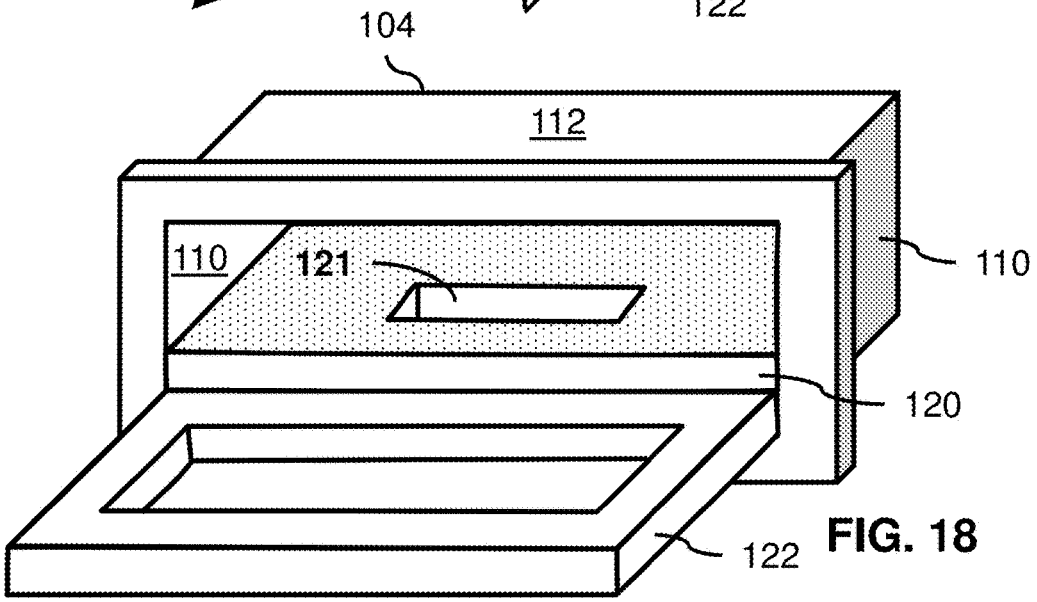
Figure 19:
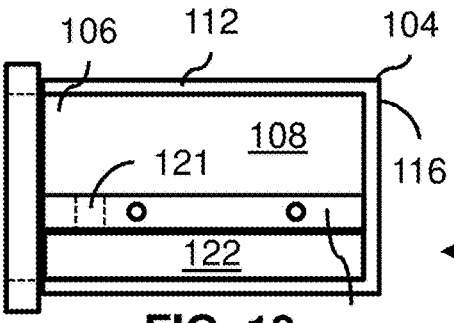
Figure 20:
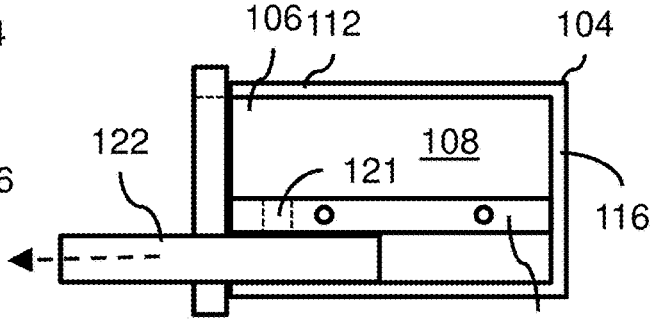

FIGS. 17 to 20 depict views of an eighth embodiment of the apparatus of FIG. 1. FIGS. 17 and 18 depict frontal perspective views. FIGS. 19 and 20 depict side views taken along the cross-sectional line A-A shown in FIG. 17.

In accordance with the embodiments as depicted in FIGS. 17 to 20, the housing assembly 104 further includes a drawer assembly 122. The drawer assembly 122 is configured to be received in a position that is located below the support assembly 120, in an open zone positioned bellow the support assembly 120 and the housing assembly 104. The drawer assembly 122 is configured to be slidably received in the housing assembly 104. A handle may be attached to the face of the drawer assembly 122 that faces outwardly from the housing assembly 104. FIG. 17 depicts the drawer assembly 122 partially extending from the interior of the housing assembly 104. FIG. 18 depicts the drawer assembly 122 fully extended from the housing assembly 104. FIG. 19 depicts the drawer assembly 122 fully received in the housing assembly 104. FIG. 20 depicts the drawer assembly 122 partially extended from the interior of the housing assembly 104. The drawer assembly 122 is configured to hold objects, such as, keys, identification papers, etc.

Figure 21:
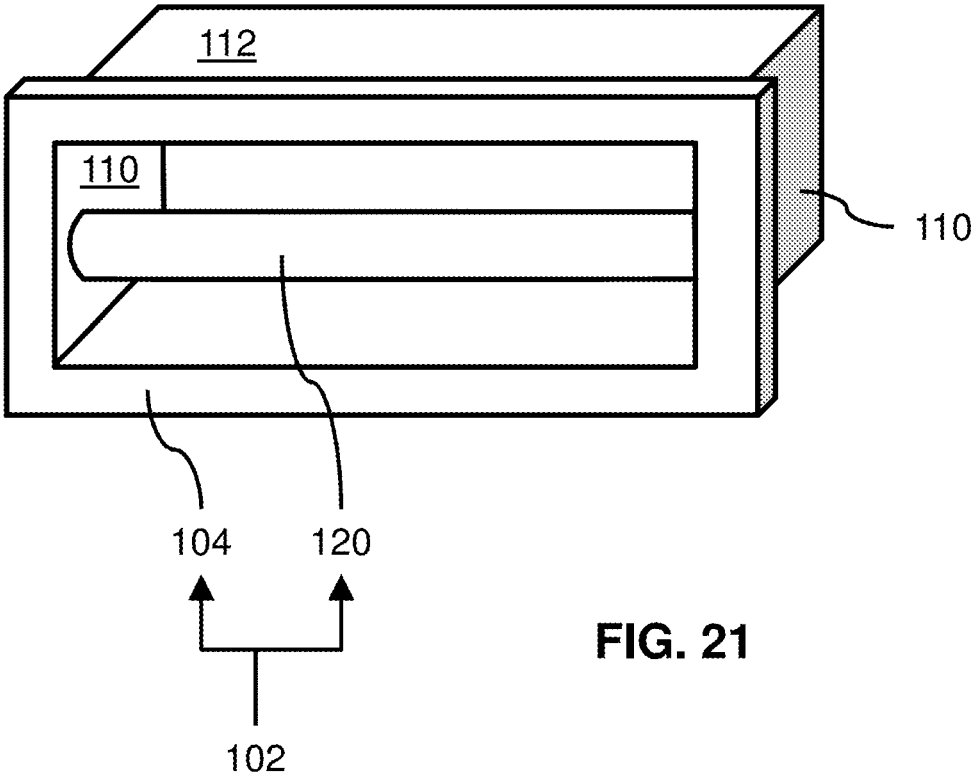
FIG. 21 (SHEET 10 of 10) depicts a view of a ninth embodiment of the apparatus of FIG. 1.

FIG. 21 depicts a frontal perspective view of a ninth embodiment of the apparatus of FIG. 1.

In accordance with the embodiment as depicted in FIG. 21, the support assembly 120 further includes (and is not limited to) a cylindrical rung (also called a tubular member or a ladder rung) that is configured to be fixedly mounted to (and span between) the opposite lateral side walls 110 of the housing assembly 104. The support assembly 120 is mounted to the frontal section of the housing assembly 104 (preferably, at a position that is proximate to the entrance of the housing assembly 104).

It will be appreciated that the description identifies and describes options and variations of the apparatus, regardless of whether the description identifies the options and/or variations of the apparatus by way of explicit terms and/or non-explicit terms. Other options for the apparatus as identified in this paragraph may include any combination and/or permutation of the technical features (assemblies, components, items, devices, etc.) as identified in the detailed description, as may be required and/or desired to suit a particular technical purpose and/or technical function. It will be appreciated, that where possible, any one or more of the technical features and/or any one or more sections of the technical features of the apparatus may be combined with any other one or more of the technical features and/or any other one or more sections of the technical features of the apparatus in any combination and/or permutation. Any one or more of the technical features and/or any one or more sections of the technical features of the apparatus may stand on its own merit without having to be combined with another other technical feature. It will be appreciated that persons skilled in the art would know that technical features of each embodiment may be deployed (where possible) in other embodiments even if not expressly stated as such above. It will be appreciated that persons skilled in the art would know that other options would be possible for the configuration of the components of the apparatus (if so desired) to adjust to manufacturing requirements and still remain within the scope of the invention as described in at least one or more of the claims. This written description uses examples to disclose the invention, including the best mode, and also to enable any person skilled in the art to make and use the invention. The patentable scope of the invention is defined by the claims, and may include other examples that occur to those skilled in the art. Such other examples are within the scope of the claims if they have structural elements that do not differ from the literal language of the claims, or if they include equivalent structural elements with insubstantial differences from the literal language of the claims. It may be appreciated that the assemblies and modules described above may be connected with each other as required to perform desired functions and tasks within the scope of persons of skill in the art to make such combinations and permutations without having to describe each and every one in explicit terms. There is no particular assembly or component that may be superior to any of the equivalents available to the person skilled in the art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) the description provided outside of this document (that is, outside of the instant application as filed, as prosecuted, and/or as granted). It is understood, for this document, that the phrase "includes" is equivalent to the word "comprising." The foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a ladder assembly being configured to be used with a vertically-extending wall assembly of a building having a window assembly installed, at least in part, in the vertically-extending wall assembly, and the ladder assembly including:

a housing assembly being configured to be fixedly received, at least in part, in the vertically-extending wall assembly, and to be mounted, at least in part, into the vertically-extending wall assembly of the building; and a support assembly being configured to be fixedly attached, at least in part, to the housing assembly, and to extend, at least in part, into the housing assembly in such a way that the support assembly bisects the housing assembly; and the support assembly, in use, providing any one of a handhold or a foothold configured for usage by a user; and wherein:

the support assembly includes a horizontal plate body configured to be received completely within an interior of the housing assembly; and the horizontal plate body of the support assembly defines a hand-holding channel that faces upwardly and downwardly; and the hand-holding channel is positioned proximate to a frontal section of the support assembly and proximate to a frontal section of the housing assembly, in which the support assembly is received in the housing assembly; and the horizontal plate body provides the foothold configured for usage by a foot of the user; and the hand-holding channel, which is defined by the horizontal plate body, provides the handhold to be grasped and held by a palm and fingers of a hand of the user; and a first mounting bracket assembly and a second mounting bracket assembly each include an L-shaped body; and the first mounting bracket assembly and the second mounting bracket assembly are configured to attach to respective spaced-apart lateral side walls of the housing assembly; and the first mounting bracket assembly and the second mounting bracket assembly are configured to attach to respective frontal portions of spaced-apart wall studs of the vertically-extending wall assembly of the building; and a frame assembly is configured to be affixed to the housing assembly; and the frame assembly extends along an outer periphery of the housing assembly; and the frame assembly includes an outer peripheral flange portion that abuts a peripheral edge surface leading to an entrance of the housing assembly; and the frame assembly is configured to be received, at least in part, in the entrance of the housing assembly; and the frame assembly defines a mounting hole positioned on an outer-facing edge of the frame assembly; and a frame connector is configured to affix the frame assembly to the housing assembly via the mounting hole positioned on the outer-facing edge of the frame assembly.

2. The apparatus of claim 1, wherein:

the housing assembly is configured to be flush mounted, at least in part, to the vertically-extending wall assembly.

3. The apparatus of claim 1, wherein:

the housing assembly is configured to be installed to, and to extend between, wall studs of the vertically-extending wall assembly.

4. The apparatus of claim 1, wherein:

the support assembly includes a non-slip surface configured to resist slippage between the user and the support assembly.

5. The apparatus of claim 1, wherein:

the support assembly is mounted with the housing assembly in an off-centered orientation in such a way that a space above the support assembly is relatively larger than a space that is located below the support assembly.

6. The apparatus of claim 1, wherein:

the housing assembly includes a lamp device.

7. The apparatus of claim 1, wherein:

the ladder assembly is installable to the vertically-extending wall assembly, in which the vertically-extending wall assembly includes an exterior wall of the building.

8. The apparatus of claim 1, wherein: the housing assembly further includes a front panel configured to fit and cover an open space that is positioned below the support assembly between the support assembly and a bottom section of the housing assembly.

9. The apparatus of claim 8, wherein:

the front panel defines a drainage portal for allowing rain water to exit from the interior of the housing assembly.

10. The apparatus of claim 1, wherein:

the housing assembly further includes a safety belt hook configured to assist the user to climb the ladder assembly.

11. The apparatus of claim 1, wherein:

the housing assembly further includes a lock panel having a lock device installed thereto; and a key is configured to lock and unlock the lock device; and the lock device is configured to securely lock a position of the lock panel to the housing assembly.

12. The apparatus of claim 1, wherein:

the housing assembly further includes a drawer assembly configured to be received in a position that is located below the support assembly, in an open zone that is positioned between the support assembly and the housing assembly.

13. The apparatus of claim 1, wherein:

a support connector is configured to securely connect the support assembly to said respective spaced-apart lateral side walls of the housing assembly; and the support assembly defines receiving holes configured to receive the support connector.

14. The apparatus of claim 1, wherein:

a front edge of the support assembly is spaced apart from a front edge of the housing assembly; and the front edge of the support assembly is located in the interior of the housing assembly.

15. The apparatus of claim 1, wherein:

the housing assembly includes a lamp device configured to be battery powered; and a bottom section located below the support assembly is fitted with a see-through panel for allowing visual access for the lamp device.

16. An apparatus, comprising:

a ladder assembly being configured to be used with a vertically-extending wall assembly of a building having a window assembly installed, at least in part, in the vertically-extending wall assembly, and the ladder assembly including:

a housing assembly being configured to be fixedly received, at least in part, in the vertically-extending wall assembly, and to be mounted to the vertically-extending wall assembly of the building, and to be positioned below the window assembly in such a way that the housing assembly extends, at least in part, into an interior of the vertically-extending wall assembly of the building and is spaced apart from the window assembly once the housing assembly is fixedly received and mounted to the vertically-extending wall assembly of the building; and a support assembly being configured to be fixedly attached to the housing assembly, and to extend into the housing assembly in such a way that the support assembly bisects the housing assembly; and the support assembly, in use, providing any one of a handhold or a foothold configured for usage by any one of a hand or a foot of a user in such a way that the user uses the support assembly to climb toward the window assembly installed in the vertically-extending wall assembly and above the housing assembly; and wherein:

the support assembly includes a horizontal plate body configured to be received completely within an interior of the housing assembly; and the horizontal plate body of the support assembly defines a hand-holding channel that faces upwardly and downwardly; and the hand-holding channel is positioned proximate to a frontal section of the support assembly and proximate to a frontal section of the housing assembly, in which the support assembly is received in the housing assembly; and the horizontal plate body provides the foothold configured for usage by the foot of the user; and the hand-holding channel, which is defined by the horizontal plate body, provides the handhold to be grasped and held by a palm and fingers of a hand of the user; and a first mounting bracket assembly and a second mounting bracket assembly each include an L-shaped body; and the first mounting bracket assembly and the second mounting bracket assembly are configured to attach to respective spaced-apart lateral side walls of the housing assembly; and the first mounting bracket assembly and the second mounting bracket assembly are configured to attach to respective frontal portions of spaced-apart wall studs of the vertically-extending wall assembly of the building; and a frame assembly is configured to be affixed to the housing assembly; and the frame assembly extends along an outer periphery of the housing assembly; and the frame assembly includes an outer peripheral flange portion that abuts a peripheral edge surface leading to an entrance of the housing assembly; and the frame assembly is configured to be received, at least in part, in the entrance of the housing assembly; and the frame assembly defines a mounting hole positioned on an outer-facing edge of the frame assembly; and a frame connector is configured to affix the frame assembly to the housing assembly via the mounting hole positioned on the outer-facing edge of the frame assembly.

17. An apparatus, comprising:

a ladder assembly being configured to be used with a vertically-extending wall assembly of a building having a window assembly installed, at least in part, in the vertically-extending wall assembly, and the ladder assembly including:

a housing assembly being configured to be fixedly received, at least in part, in the vertically-extending wall assembly, and to be mounted, at least in part, to the vertically-extending wall assembly of the building, and to be positioned below the window assembly in such a way that the housing assembly extends, at least in part, into an interior of the vertically-extending wall assembly of the building and is spaced apart from the window assembly once the housing assembly is fixedly received and mounted to the vertically-extending wall assembly of the building; and the housing assembly forming an entrance channel leading to a housing cavity being defined by the housing assembly; and the housing assembly including opposite lateral side walls, a top wall, a bottom wall and a back wall defining the housing cavity; and a support assembly being configured to: (A) be fixedly attached to the opposite lateral side walls of the housing assembly, and (B) extend, at least in part, into a mid-section of the housing cavity of the housing assembly in such a way that the support assembly (a) bisects the housing assembly, (b) extends between the opposite lateral side walls of the housing assembly, (c) is spaced apart from, and is positioned between, the top wall and the bottom wall of the housing assembly, and (d) extends, at least in part, into the housing cavity of the housing assembly; and the support assembly, in use, providing any one of a handhold or a foothold configured for usage by any one of a hand or a foot of a user in such a way that the user uses the support assembly to climb toward the window assembly installed in the vertically-extending wall assembly and above the housing assembly; and wherein:

the support assembly includes a horizontal plate body configured to be received completely within an interior of the housing assembly; and the horizontal plate body of the support assembly defines a horizontally aligned hand-holding channel that faces upwardly and downwardly; and the hand-holding channel is positioned proximate to a frontal section of the support assembly and proximate to a frontal section of the housing assembly, in which the support assembly is received in the housing assembly; and the horizontal plate body provides the foothold configured for usage by the foot of the user; and the hand-holding channel, which is defined by the horizontal plate body, provides the handhold to be grasped and held by a palm and fingers of a hand of the user; and a first mounting bracket assembly and a second mounting bracket assembly each include an L-shaped body; and the first mounting bracket assembly and the second mounting bracket assembly are configured to attach to respective spaced-apart lateral side walls of the housing assembly; and the first mounting bracket assembly and the second mounting bracket assembly are configured to attach to respective frontal portions of spaced-apart wall studs of the vertically-extending wall assembly of the building; and a frame assembly is configured to be affixed to the housing assembly; and the frame assembly extends along an outer periphery of the housing assembly; and the frame assembly includes an outer peripheral flange portion that abuts a peripheral edge surface leading to an entrance of the housing assembly; and the frame assembly is configured to be received, at least in part, in the entrance of the housing assembly; and the frame assembly defines a mounting hole positioned on an outer-facing edge of the frame assembly; and a frame connector is configured to affix the frame assembly to the housing assembly via the mounting hole positioned on the outer-facing edge of the frame assembly.

* * * * *